US006769747B2

(12) United States Patent
Chan et al.

(10) Patent No.: US 6,769,747 B2
(45) Date of Patent: Aug. 3, 2004

(54) TABLE

(75) Inventors: Eric Ping Pang Chan, New York, NY (US); Rama Chorpash, New York, NY (US); Thomas William Granzow, Byron Center, MI (US); Andrew J. Kurrasch, Saugatuck, MI (US); Jeffrey Fredrick Miller, New York, NY (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/941,157

(22) Filed: Aug. 27, 2001

(65) Prior Publication Data

US 2002/0040668 A1 Apr. 11, 2002

Related U.S. Application Data

(60) Provisional application No. 60/229,210, filed on Aug. 31, 2000.

(51) Int. Cl.[7] ..... A47B 13/00

(52) U.S. Cl. ..... 312/157.16; 108/50.02; 108/159; 312/249.11

(58) Field of Search ..... 108/50.02, 157.16, 108/159, 90, 93; 312/223.6; 248/188, 188.9, 188.8; D6/499, 458, 462, 487; 160/127, 351; 403/408.1, 286

(56) References Cited

U.S. PATENT DOCUMENTS

| | | | | |
|---|---|---|---|---|
| 2,367,948 A | * | 1/1945 | Kirsch | 108/90 |
| 2,370,419 A | * | 2/1945 | Watrous et al. | 383/112 |
| D171,618 S | | 3/1954 | Roth | |
| D171,619 S | | 3/1954 | Roth | |
| 2,740,679 A | | 4/1956 | Vizzini | |
| D187,137 S | | 2/1960 | Christenson, Jr. | |
| 3,326,147 A | | 6/1967 | Toney | |
| 3,731,859 A | | 5/1973 | Bean, Jr. | |
| 4,226,190 A | | 10/1980 | Ashton | |
| D257,812 S | | 1/1981 | Cyplik | |
| 4,516,620 A | | 5/1985 | Mulhern | |

(List continued on next page.)

FOREIGN PATENT DOCUMENTS

FR 1282874 * 12/1961

OTHER PUBLICATIONS

"Nordisk," IKEA advertising excerpt, date unknown.
"Propeller Table," The Knoll Shop advertising excerpt, date unknown.
"Crossings," Haworth advertising excerpt, date unknown.
"Here Rectangular Table," NextOffice advertising excerpt, date unknown.
"Bretford Luna Table," NextOffice advertising excerpt, date unknown.
"Sitag Table Desk," Next Office advertising excerpt, date unknown.

(List continued on next page.)

*Primary Examiner*—Lanna Mai
*Assistant Examiner*—John Fitzgerald
(74) *Attorney, Agent, or Firm*—Brinks Hofer Gilson & Lione

(57) ABSTRACT

A table includes a support structure comprising a first wire support and a second wire support. Each of the first and second wire supports comprises opposite ends that are joined to define a first and second foot. A portion of each of the first and second wire supports form a first and second support platform respectively. A work surface is supported on the first and second support platforms. In another aspect, a preferred embodiment of the support structure further comprises a first and second cap member disposed on an upper surface of the work surface and connected to the first and second support platforms such that the work surface is clamped therebetween. In another aspect, an accessory includes a mounting portion that is disposed between a first surface of a work surface and one of the support platform and the cap member. The cap member is connected to the support platform with the mounting portion clamped between one of the support platform and the cap member and the work surface.

14 Claims, 12 Drawing Sheets

U.S. PATENT DOCUMENTS

| | | | | | |
|---|---|---|---|---|---|
| 4,759,520 | A | | 7/1988 | Levine | |
| 4,784,468 | A | | 11/1988 | Tierney | |
| 4,874,027 | A | | 10/1989 | Boundy et al. | |
| 4,901,867 | A | | 2/1990 | Petty, Jr. | |
| 4,974,913 | A | * | 12/1990 | Vogt et al. | 312/195 |
| D325,836 | S | | 5/1992 | Morton | |
| 5,115,345 | A | | 5/1992 | Hobson et al. | |
| 5,152,407 | A | | 10/1992 | Massoudnia et al. | |
| 5,177,912 | A | | 1/1993 | Ball | |
| 5,251,973 | A | | 10/1993 | Hazan | |
| 5,335,432 | A | | 8/1994 | Simpson | |
| D353,946 | S | | 1/1995 | Fischer et al. | |
| D371,262 | S | | 7/1996 | Forbes, Sr. | |
| D374,512 | S | | 10/1996 | Kiley et al. | |
| D383,337 | S | | 9/1997 | Lerner | |
| 5,730,666 | A | | 3/1998 | Hudson | |
| 5,875,597 | A | | 3/1999 | Gingrich et al. | |
| 5,877,896 | A | | 3/1999 | Gremban | |
| 5,890,782 | A | | 4/1999 | Alberts | |
| 5,908,002 | A | | 6/1999 | Alexander et al. | |
| 5,966,879 | A | | 10/1999 | Verbeek et al. | |
| 6,012,688 | A | * | 1/2000 | LaMotte | 248/165 |
| 6,032,684 | A | | 3/2000 | Narron | |
| D423,828 | S | | 5/2000 | Wilkinson | |
| D427,783 | S | | 7/2000 | Luedke | |
| 6,101,954 | A | | 8/2000 | Rein et al. | |
| 6,170,410 | B1 | * | 1/2001 | Gioacchini et al. | 108/153.1 |
| 6,213,191 | B1 | | 4/2001 | Nitzsche | |
| 6,568,335 | B2 | * | 5/2003 | Hamilton et al. | 108/50.02 |

OTHER PUBLICATIONS

"Spacecraft 01. Basic Work Table," Next Office advertising excerpt, date unknown.

"Dordoni Worktop," Design Within Reach advertising excerpt, date unknown.

"Transporte Table," Design Within Reach advertising excerpt, date unknown.

"Gordon Accordion Table," Next Office advertising excerpt, date unknown.

Business Furniture Files & Carts, Quill Catalog, p. 743, date unknown.

"elfa® Home Office" and "elfa® Kitchen Cart", The Container Store, <www.container.com>.

Mail cart 33167, <www.NationalBusinessFurniture.com>, catalog p. 99, date unknown.

Salterini, May 16, 1949, p. 19, table legs at top, copy in design library.

* cited by examiner

TABLE

This application claims the benefit of U.S. Provisional Application S/No. 60/229,210, filed Aug. 31, 2000, the entire disclosure of which is hereby incorporated herein by reference.

BACKGROUND

The present invention relates generally to tables and work spaces, and in particular, to a table having an improved support structure, to a method for assembling the table and to an improved storage device.

Tables and desks of the type typically used in offices and the like are typically configured with complicated support structures that require a plurality of various fasteners and the like, and which usually are assembled by skilled installers and/or mechanics. Moreover, such support structures are often made of relatively heavy and expensive materials, which can increase the costs of manufacturing and shipping such structures. Indeed, because of the difficulty in assembling such tables, various accessories, such as screens and the like, are not typically attached to the interface of the support structure and the work surface, but rather are otherwise attached with additional fasteners or mechanisms at other locations, or are separately supported on the floor. As such, additional parts typically are required to fully assemble the work space, which in turn can increase the costs of manufacture and assembly thereof.

In addition, accessories, such as privacy screens, are generally planar in construction, and are typically disposed along, or attached to, one or more linear edges of a table. As such, typical privacy screens are two-dimensional, and are not capable of providing three-dimensional coverage, for example over a comer of a desk.

In addition to these various shortcomings associated with various conventional tables and desks, office system storage devices are typically made of relatively heavy sheet metal or wood, which can be expensive to manufacture and/or assemble. Moreover, such storage devices, with their relatively heavy weight, are not typically portable or mobile. As such, typically storage devices do not lend themselves to easy reconfiguration of a work space. In addition, such devices are generally only laterally accessible by way of doors or sliding drawers, which occupy an enlarged footprint when opened. Alternatively, certain storage devices have openings or are open on all sides thereof so as to expose the contents of the storage device, which may not be aesthetically pleasing.

SUMMARY

Briefly stated, in one aspect of the invention, one embodiment of a table comprises a support structure comprising a first wire support and a second wire support. Each of the first and second wire supports comprises opposite ends that are joined to define a first and second foot. A portion of each of the first and second wire supports form a first and second support platform respectively. The first wire support comprises a first segment extending upwardly from the first foot to the first support platform and a second segment extending from the first support platform to the second foot. The second wire support comprises a first segment extending upwardly from the second foot to the second support platform and a second segment extending from the second support platform to the first foot. A work surface is supported on the first and second support platforms.

In a preferred embodiment, the support structure further comprises a third wire support comprising opposite ends joined to the first and second feet. A portion of the third wire support forms a third support platform. The third wire support comprises a first segment extending from the first foot to the third support platform and a second segment extending from the second foot to the third support platform.

Also in a preferred embodiment, the support structure further comprises a first and second cap member disposed on an upper surface of said work surface. The first cap member is connected to the first support platform and the second cap member is connected to the second support platform such that the work surface is clamped between the first and second cap members and the first and second support platforms respectively.

In another aspect of the invention, an accessory includes a mounting portion that is disposed between a surface of the work surface and one of the support platform and the cap member. The cap member is connected to the support platform with the mounting portion clamped between one of the support platform and the cap member and the work surface.

In yet another aspect of the invention, a privacy screen comprises a pole having a curved portion and a sheet material web. The sheet material web has a first edge portion connected to the pole and a second edge portion. The second edge portion is positioned such that the sheet material web has a non-planar contour. In a preferred embodiment, the sheet material web is made of a bi-directional stretchable material.

In a preferred embodiment, the screen comprises a mounting portion that is disposed between one of the support platform and the cap member and the work surface. Preferably, the pole extends out of a plane defined by the work surface.

In other aspects of the invention, methods for assembling a table and for providing privacy to a workspace are provided.

In yet another aspect of the invention, a storage device comprises a frame comprising a front and back frame member and a plurality of horizontal side frame members vertically spaced along opposite sides of the frame. The side frame members connect the front and back frame members. The front frame member is generally open. A sheet material web is disposed over at least the opposite sides of the frame to define a pair of side walls. The sheet material web is preferably connected to the frame adjacent the front frame member. In a preferred embodiment, the frame members are made of wire. Also in a preferred embodiment, the sheet material web is made of a flexible material, including for example, a fabric or plastic.

The present inventions provide significant advantages over other tables, desks and accessories, including for example, various screens and storage devices. For example, the support structure can be easily connected to the work surface with a minimal number of fasteners. In addition, the support structure, which is preferably made of wire, can be made inexpensively, and is relatively light weight. At the same time, the wire support structure provides a distinctive visual appearance to the table that is aesthetically pleasing.

In addition, the support structure can be easily, temporarily disconnected from the work surface, so as to allow an accessory to be mounted therebetween. In this way, the user avoids the need for additional fasteners and the like for attaching the accessory the table. At the same time, the accessory is rigidly connected to the robust support structure, rather than only to the work surface.

The privacy screen also provides distinct advantages over conventional screens. For example, the screen can be arranged to assume a three-dimensional contour. In this way, the screen can be disposed, for example, over the comer of a table to shield the user from both the back and side of the desk, as well as from above the desk. At the same time, the preferred bi-directional stretchable material allows the manufacturer to use a relatively simple two-dimensional pattern for the sheet material web that can be stretched into the three-dimensional configuration. The screen also is relatively lightweight and easy to assemble.

The storage device also provides significant advantages. In particular, the construction and materials of the frame and sheet material web make the storage device relatively lightweight, thereby allowing the user to easily move the storage device from one location to the next. Indeed, in a preferred embodiment, the storage device is provided with wheels to facilitate the mobility thereof. In addition, the sheet material web can be easily connected to the frame without the need for expensive fasteners and the like. Moreover, the storage device, which is preferably open both from the front and the top, can be easily accessed from the top and front without increasing the overall foot print of the device. At the same time the storage device, with its frame and web, has a distinctive appearance with aesthetically pleasing features.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

Figure 1:
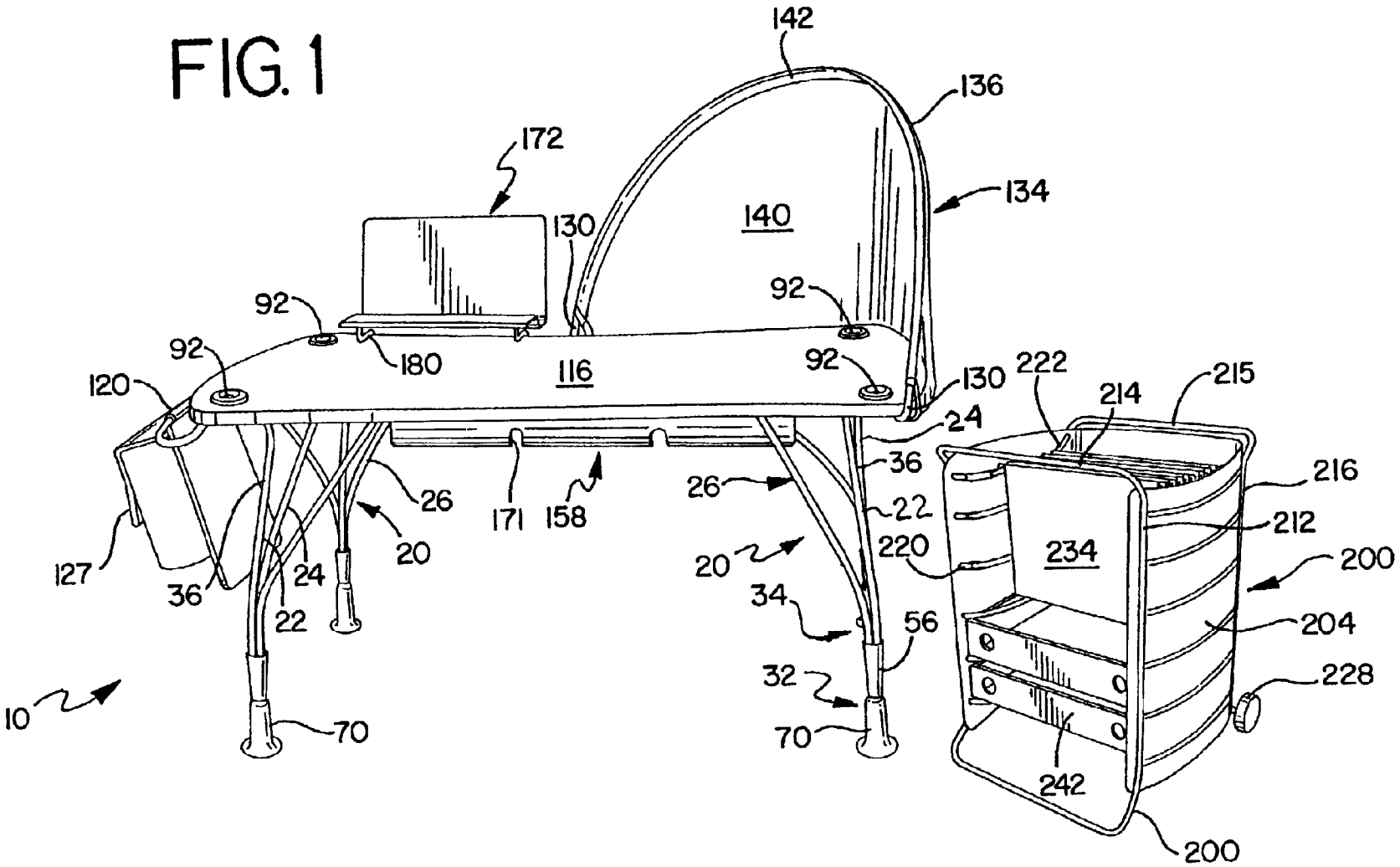
FIG. 1 is a perspective view of a table with a screen, a hanger rail, a support accessory and a mounting member attached thereto.
Figure 2:
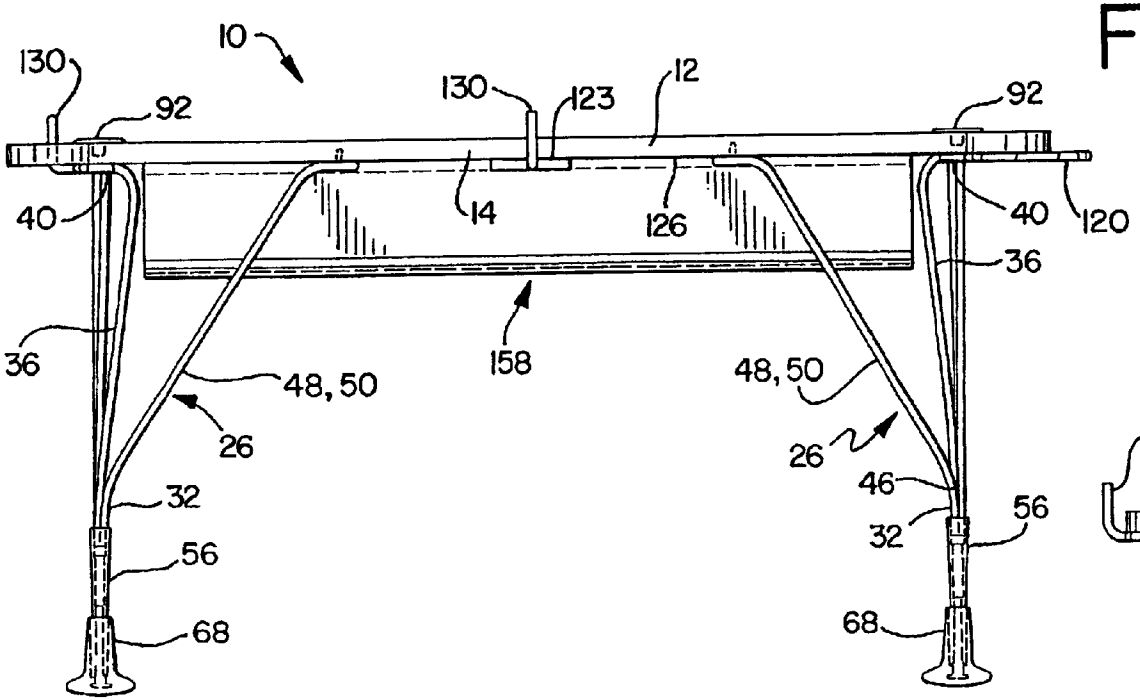
FIG. 2 is a front view of the table.
Figure 3:
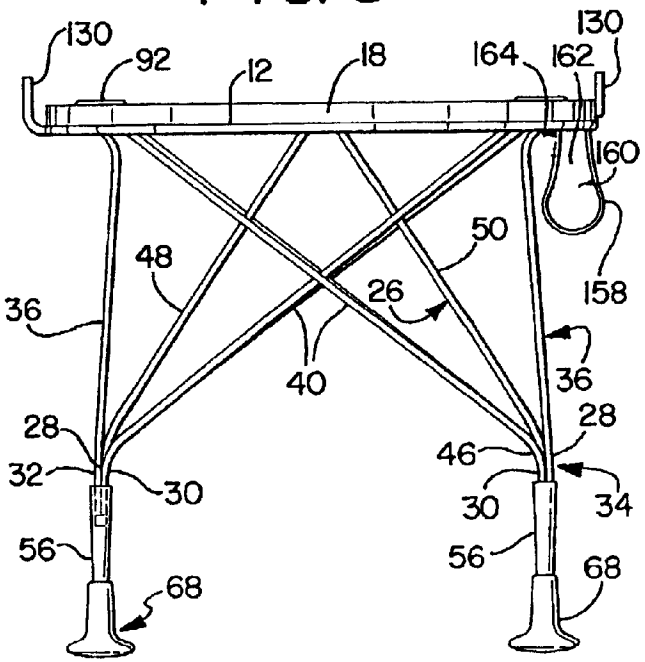
FIG. 3 is a side view of the table.
Figure 17:
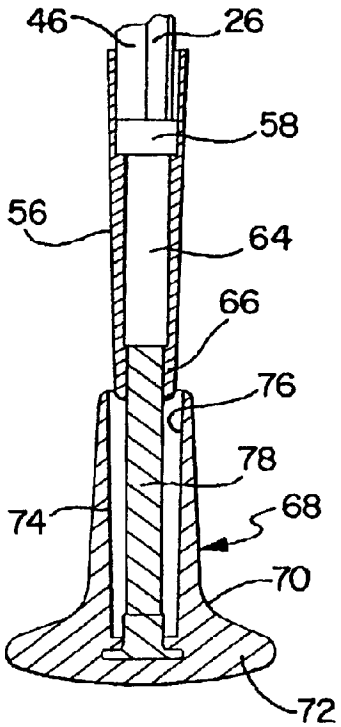
FIG. 17 is an enlarged cross-sectional view of a foot of the support structure with a glide attached thereto taken along line 17—17 of FIG. 4.
Figure 4:
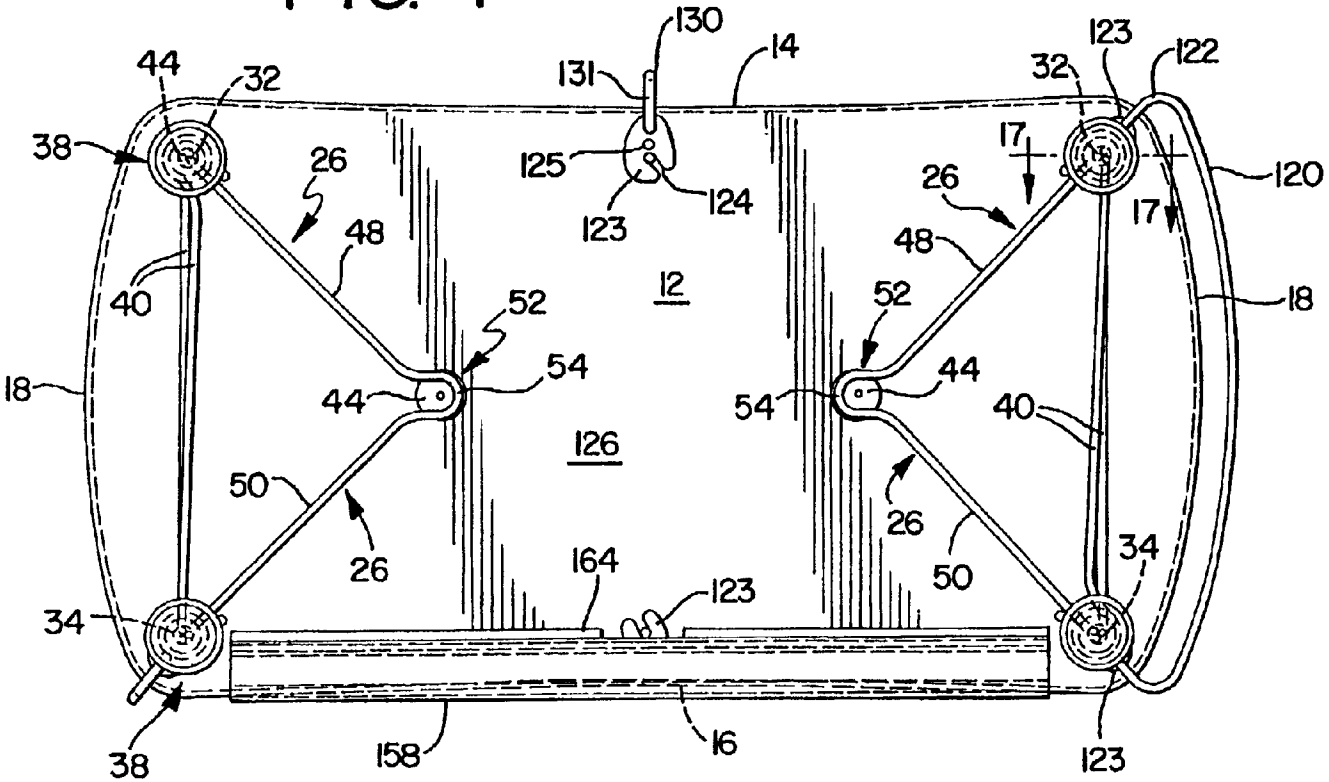
FIG. 4 is a bottom view of the table.

The terms "front", "side", "back", "forwardly", "rearwardly", "upwardly" and "downwardly" as used herein are intended to indicate the various directions and portions of the table as normally understood when viewed from the perspective of a user facing the table. Likewise, the term "lateral" refers to the direction running the length of the table from one side to the other, while the term "longitudinal" refers to the direction running from the front to the back thereof.

Referring to the drawings, and as best shown in FIGS. 1–8 and 17, a preferred embodiment of a table includes a pair of support structures 20 positioned on opposite ends of the table. Each support structure 20 preferably comprises a first, second and third support members 22, 24, 26, preferably each configured as a wire support. The first and second support members 22, 24 each include opposite ends 28, 30 that are joined to define in part a first and second foot 32, 34, with the first foot 32 preferably spaced longitudinally from the second foot 34. The first support member 22 includes a first segment 36 that extends upwardly from the wire support member to a support platform 38. The support platform 38 is preferably formed in part by a portion of the first support member 22, which is formed into a U-shaped support segment 42. The support segment is preferably formed in a horizontal plane, and preferably has a inner diameter of about 0.78 inches. The term "support platform" means generally a member or portion that provides support, and should not be limited to a horizontal, planar or flat member or surface. In a preferred embodiment, the support platform further comprises a mounting plate 44, preferably circular, which is attached to an upper surface of the support segment 42, preferably by welding. The mounting plate 44 preferably has an opening therethrough positioned preferably in the center thereof. Preferably, the mounting plate 44 is welded to the support segment 42, although other means of attachment, such as adhesive, a snap-fit or mechanical fasteners could also be used.

The first support member 22 further comprises a second wire segment 40 extending downwardly and rearwardly from the support platform toward the second foot 34. Preferably, the first, second and support segments 36, 40, 42 are formed from a single piece of steel wire, preferably having about a ⅜ inch diameter.

The second support member 24 is substantially a mirror image of the first wire support, and includes a first and second wire segment 36, 40 joined at a support platform 38 comprising a U-shaped support segment 42. The support platform 38 further preferably comprises a mounting plate 44 attached to an upper surface of the support segment 42. Each of the support platforms 38 further comprises a threaded or male fastener 90 that extends upwardly through the opening in the plate member. In one embodiment, the fastener is welded to the plate member, although it can alternatively be threaded through the opening in the plate member 44, or be simply preferably inserted therethrough with the plate member acting as a washer.

Each support structure 20 further preferably comprises a third support member 26, also preferably formed as a wire support. The third support member 26 comprises opposite ends 46 that are joined to the ends 28, 30 of the first and second wire support at each of the first and second feet 32, 34. The third support member 26 includes a first segment 48 extending upwardly and laterally and longitudinally inwardly from the first foot 32 to a third support platform 52, and a second segment 50 extending upwardly and laterally and longitudinally inwardly from the second foot 34 to the third support platform 52. The third support platform 52 is preferably formed by a portion of the third support member 26, which is formed into a U-shaped support segment 54. The support segment 54 is preferably formed in a horizontal plane. A mounting plate member 44 is preferably attached to an upper surface of the support segment 54 to further define the third support platform 52. Preferably, the three support platforms 38, 52 and in particular the upper surface of the mounting plates, lie in the same substantially horizontal plane.

Each of the ends 28, 30, 46 of the first, second and third support members 22, 24, 26 is substantially vertically oriented. In a preferred embodiment, the ends 28, 30, 46 of each support member are attached to form the first and second feet 32, 34. Preferably, the ends are welded together.

Alternatively, each of the ends are inserted into an elongated stem 56, best shown in FIGS. 2, 3, 16 and 17, having a cavity 58 opening to one end thereof. Preferably, the ends are first welded and then inserted into the cavity 58 of the stem, where they can then further be welded to the stem. The opposite end 62 of the stem includes a threaded opening 66. The stem 56 has a longitudinally extending bore 64 connecting the threaded opening 66 and the cavity 58. A glide 68 includes a housing 70 having a foot portion 72 and an upwardly extending stem 74. The stem 74 preferably is hollow and opens to a top end 76 thereof. A threaded shaft 78 or bolt extends upwardly from the foot portion 72 into the hollow stem 74. The shaft 78 engages the threaded opening 66 of the stem 56, and can extend into the bore 64 as the glide 68 is threadably engaged with the stem 56. The stem 56 is received in the stem 74. In operation, the user rotates the glide 68 to adjust the relative height of one or more of feet 32, 34 to level the table 10.

Figure 5:
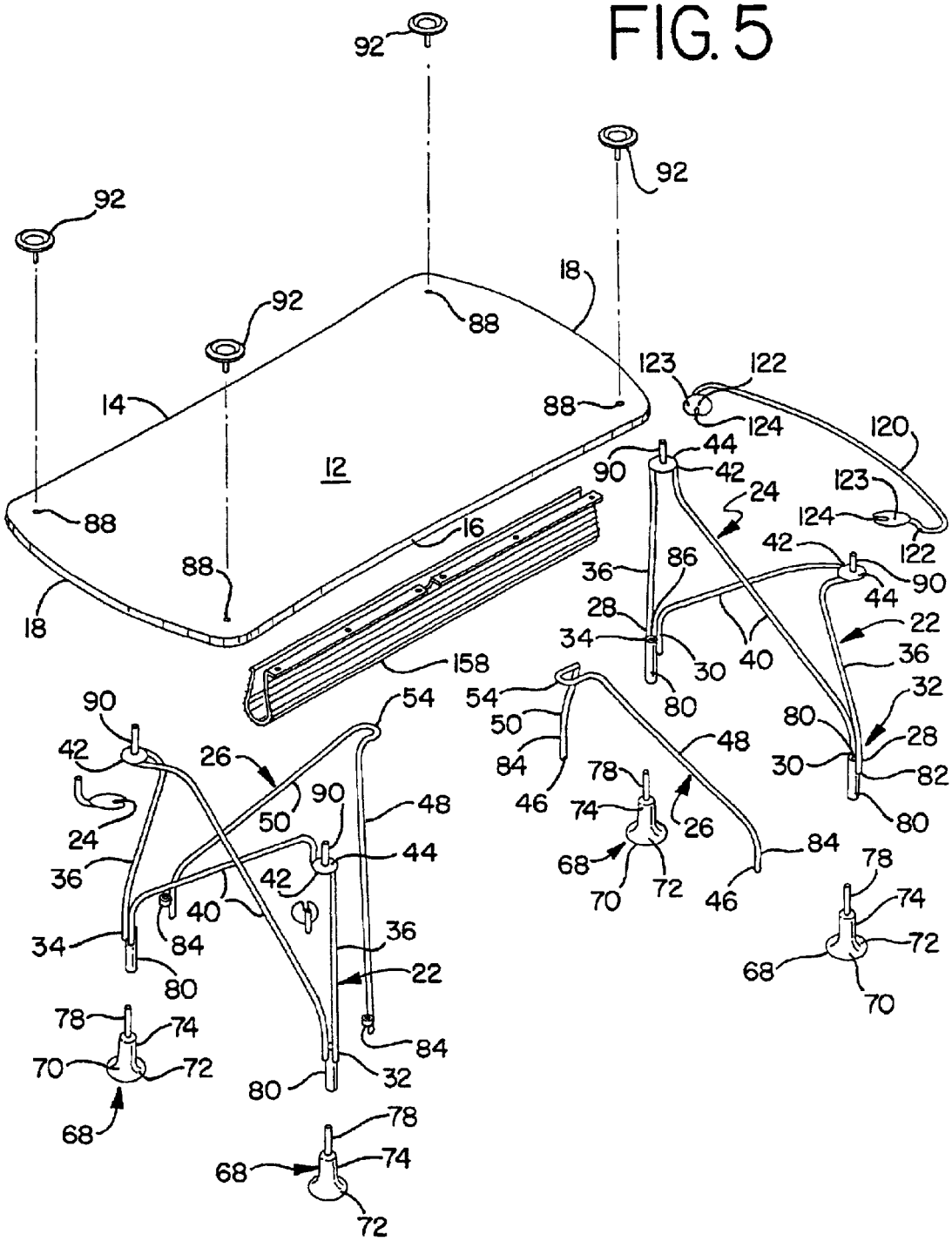
FIG. 5 is an exploded perspective view of one embodiment of the table.
Figure 6:
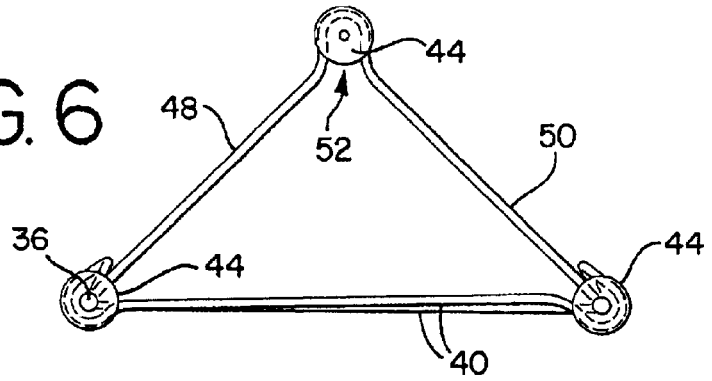
FIG. 6 is a top view of the support structure.
Figure 7:
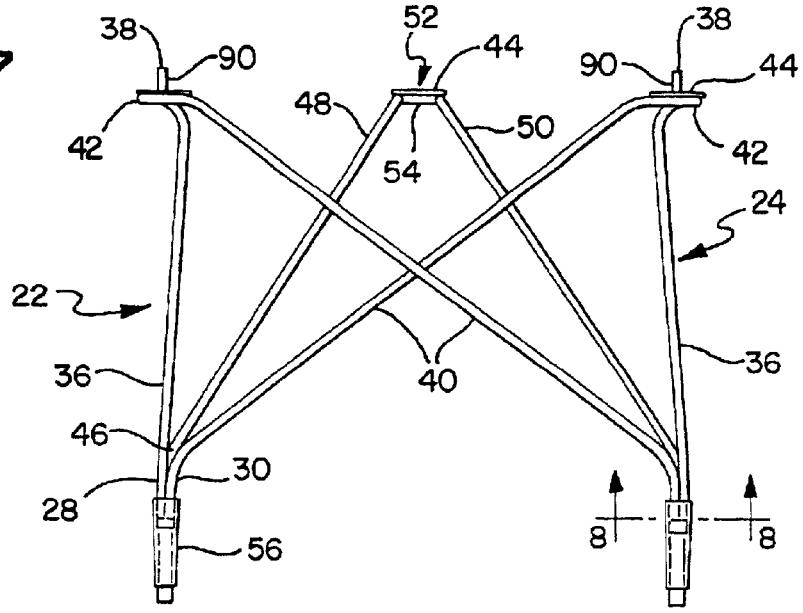
FIG. 7 is a side view of the support structure.
Figure 8:
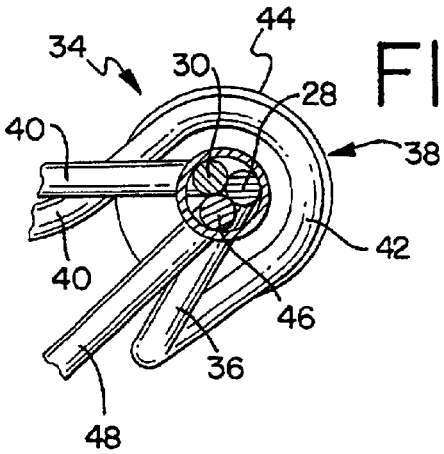
FIG. 8 is a cross sectional view of the support structure taken along line 8—8 of FIG. 7.
Figure 9:
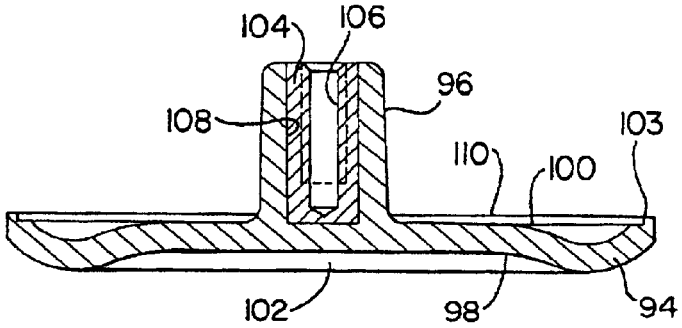
FIG. 9 is a cross-sectional view of a cap member.
Figure 10A:
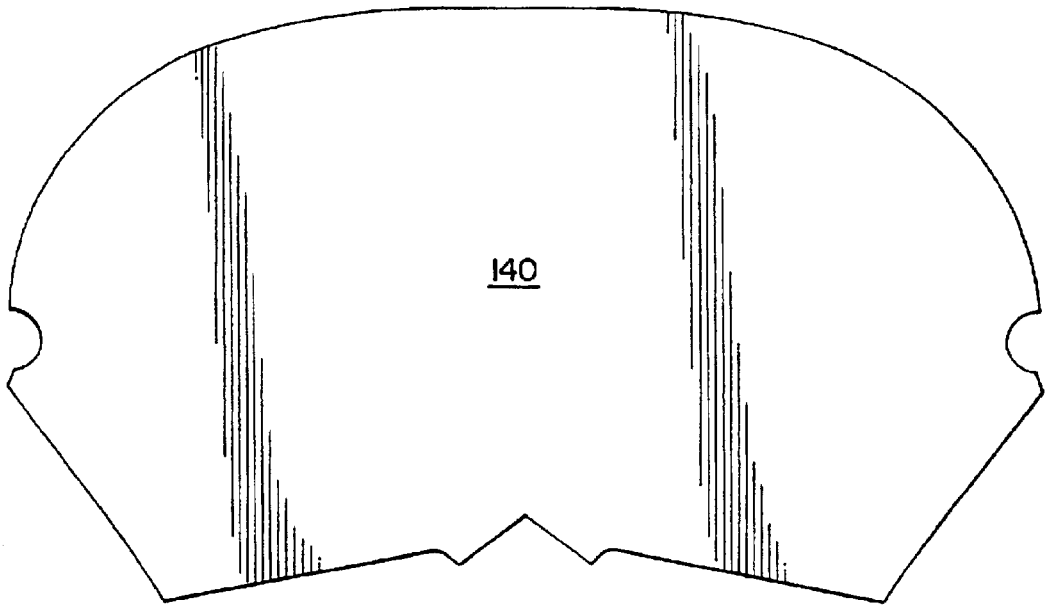
FIG. 10A is a two-dimensional screen fabric blank.
Figure 10B:
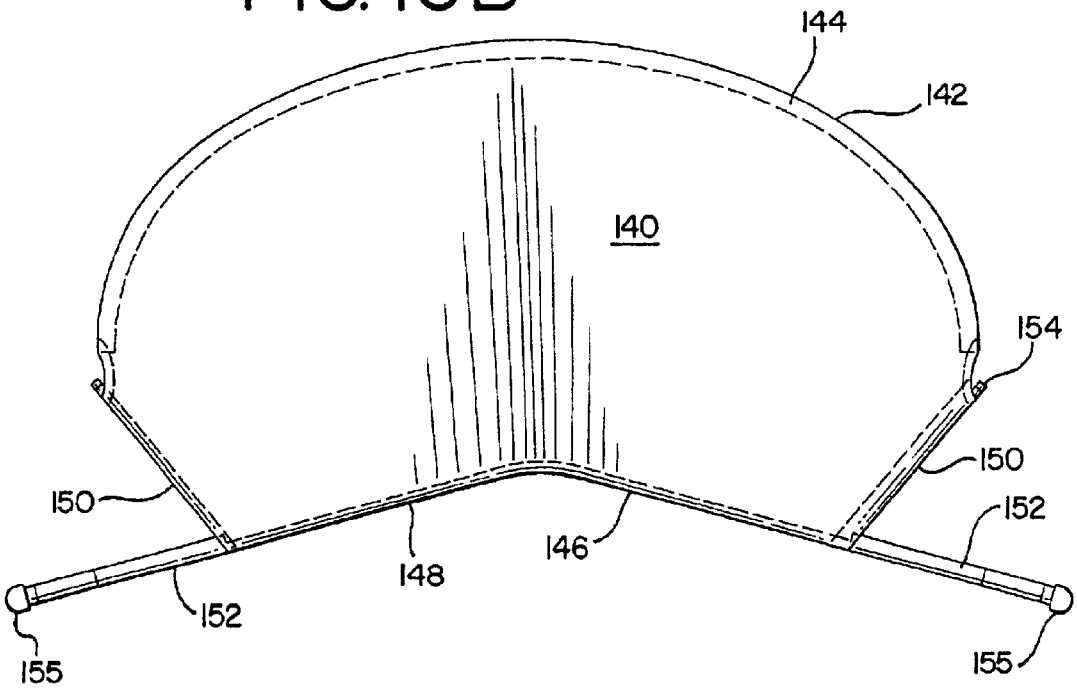
FIG. 10B is a two-dimensional flat pattern of the screen.
Figure 18:
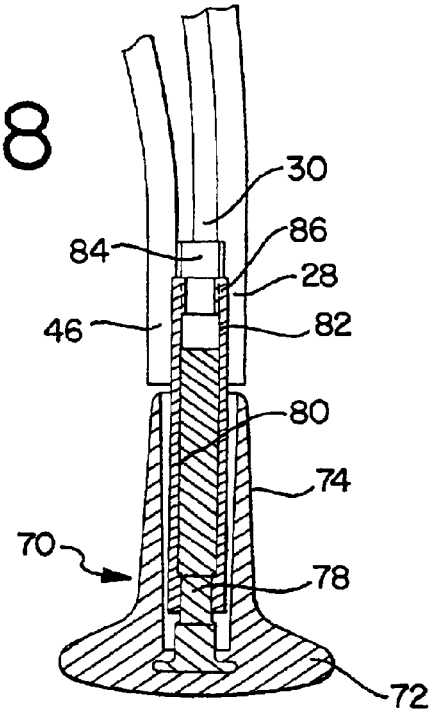
FIG. 18 is an enlarged cross-sectional view of an alternative embodiment of the support structure foot with a glide attached thereto.

In an alternative embodiment, shown in FIGS. 5 and 18, the ends 28, 30 of the first and second support members 22, 24 are attached to an elongated stem 80 and, preferably to an outer surface 82 thereof by welding. The stem 80 has opposite open ends, both of which are preferably threaded. The ends 46 of the third support member each further include a collar 84 attached thereto, preferably by welding. The collar 84 is arranged a sufficient distance from the bottom of the end 46 such that it overlies a top 86 of the stem 80 as the third support member 26 is positioned adjacent the first and second supports members 22, 24. A fastener, preferably a threaded screw extends through the collar 84 and threadably engages the stem 80. A glide 68, preferably as described above, is threadably and adjustable engaged with the stem 80, which includes a threaded opening and a bore and which is received in stem 74.

As shown in FIGS. 1–5, a worksurface 12 is supported on a pair of support structures 20, each configured with a pair of support platforms 38 and a support platforms 52. It should be understood that more than two support structures, having two or three support members, can be used to support a work surface. In a preferred embodiment, the worksurface is made of prefaced particle board, and preferably a melamine faced particle board, although it should be understood that the worksurface could be made of any number of different materials, including metal, plastic, fiberglass, or other wood products. For example, in an alternative preferred embodiment, the worksurface is comprised of a 3 inch cell corrugated honeycomb core sandwiched between a pair of hardboard layers, and an upper surface preferably finished with a lacquer. The worksurface preferably has a convex side edges 18 and concave front and rear edges 14, 16. The worksurface preferably includes a bumper, preferably made of PVC, covering the edges thereof, and extending around the periphery of the work surface. The bumper is secured with fasteners, tangs, and adhesive or like fasteners. The worksurface 12 preferably has a plurality of openings 88 overlying the openings formed in the mounting plate members 44 of the support platforms 38.

During installation, the user positions a bottom surface 126 of the work surface 12 on top of the support platforms 38, 52 with the fasteners 90 or shaft extending upwardly into the opening 88 formed through the worksurface 12. A cap member 92 is then installed to connect the work surface to the support platforms 38. In a preferred embodiment, the cap member 92 comprises a circular cap portion 94 and a stem portion 96 extending outwardly therefrom. The cap portion 94 preferably includes curvilinear top portion 98. In an alternative embodiment, the cap member includes a flat bottom portion 100, which is preferably formed as a plate member 100 attached to the cap member. Preferably, the cap member is made of an ABS material or hard plastic, although it could be made out of metal or any other suitable material. The top portion 98 defines a recess 102 in the middle of the cap member. The stem 96 further includes an insert 104 having a threaded opening 106 formed longitudinally therein. The insert 104, which is preferably brass, is press fit into a longitudinally extending cavity 108 formed in the stem. Alternatively, the insert can be secured in the stem with adhesives and the like. The stem 96 of the cap member 92 is inserted into the opening 88 formed in the work surface 12, such that the threaded opening in the insert is threadably engaged with the fastener 90 extending upwardly from the support platform 38. In one embodiment, the cap member 92 includes a lip portion 103 formed around a periphery thereof. The lip portion 103 engages and preferably flexes against a top surface 112 of the work surface. Alternatively, a bottom surface of the plate member of the cap member engages the top surface of the work surface. The cap member 92, or the fastener 90, is rotated by the user, and is threadably engaged with fastener 90 or member 92 respectively, to clamp the work surface 112 to the support platforms 38 in a simple easy operation. When installed, the cap portion 94 of the cap member preferably has at least a portion raised above the top surface 112 of the work surface 12, as shown for example in FIGS. 2 and 3.

In an alternative embodiment, the cap member comprises a downwardly extending threaded shaft that is threadably engaged with a threaded opening formed in the mounting plate. The cap member is rotated to clamp the worksurface between the cap and the support platforms.

When the third support member is employed, a fastener 114 is inserted through the opening in the plate member 44 and is directly threadably engaged with the work surface member 12. Alternatively, an insert is embedded in a bottom surface of the worksurface. The insert includes a threaded opening that threadably receives the fastener 114. Of course, it should be understood that the work surface could further be secured to the third support platform with a cap member, as described above, but that in a preferred embodiment, it is preferred that the work surface be maintained flat and free of obstacles in the region overlying the third support platform 52. If a cap member is used to secure the worksurface to the third support platform, the cap position is preferably recessed completely in the worksurface such that it does not have any portion raised thereabove.

Figure 26:
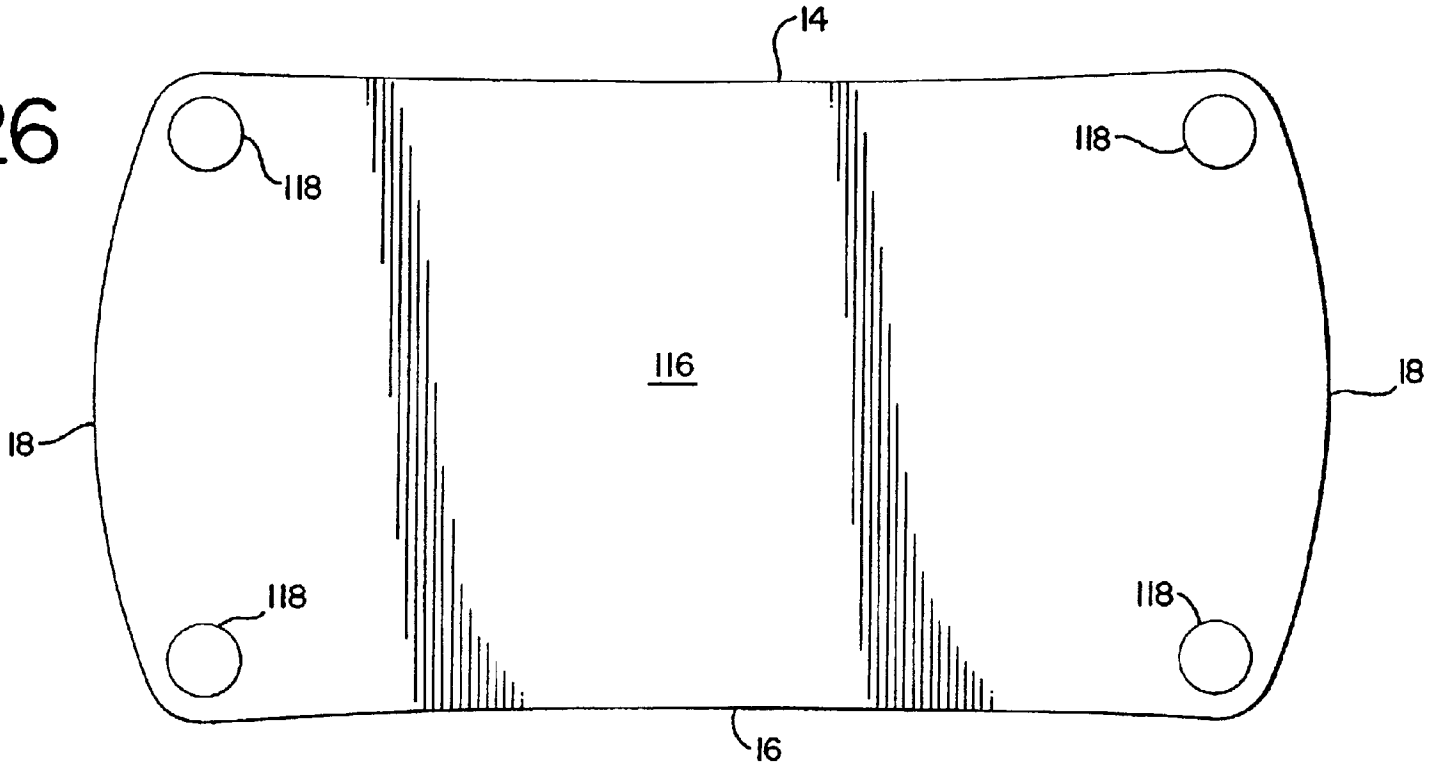
FIG. 26 is a top view of a second work surface.

In a preferred embodiment, a second work surface 116 or cover shown in FIG. 26, which is preferably thinner than the first work surface, is disposed on the upper surface 112 of the first, lower work surface 12. The second work surface 116 or cover is preferably made of MATTE PETG sheet, and is preferably about 0.02 inches thick. The second work surface 116 has four openings 118 dimensioned to receive the cap member 92. In this way, the second work surface 116 is placed on top of the first work surface 12, with the openings 118 indexed on the cap portion 94 of the cap members 92. The user can easily replace or remove the second work surface as desired, for example, to alter the color, surface texture or material of the second work surface as desired. In addition, the second work surface 116 can be easily removed for cleaning or disposal as needed, with a replacement work surface 116 easily disposed on the work surface 12. Although the second work surface is preferably disposed on the first work surface, without other attachment devices, it should be understood that the two work surfaces could be joined with adhesives, Velcro and/or other types of fasteners, including various mechanical fasteners. The second work surface preferably has substantially the same shape as the lower work surface 12, including opposite convex side edges 18 and concave front and rear edges 14, 16, although it preferably is dimensioned to leave a slight reveal of the upper surface of the first work surface around the peripheral edge thereof.

Referring to FIGS. 1–5, an accessory is shown as being supported on the table. The accessory, shown as a hanger rail 120, preferably includes a curvilinear rail, which is preferably formed in a horizontal plane, and which preferably has a contour that maps the contour of, and is spaced substantially equidistance from, the side edge 18 of the work surface 12. The ends 122 of the rail are curved inwardly and are connected to a mounting portion 123, preferably formed as a plate member having a slot 124 formed therein. Various storage devices, such as bags 127, hangers, trays and the like can be suspended from the rail. During installation, the cap member 92 is loosened from its connection with the support platforms 38, 52. The mounting portion 123 is then preferably slid between the support platform 38 and the bottom surface 126 of the work surface 12, with the fastener 88 received in the slot 124 formed in the mounting plate 123. The mounting plate further includes a hole 125, which is used to suspend the mounting plate as it is painted or otherwise finished. Of course it should be understood that fasteners also could be inserted through the hole 125 to attach the mounting plate to the table. In an alternative embodiment, the mounting plate is disposed between the cap portion and the upper surface of the worksurface and clamped therebetween. In either embodiment, the cap member 92, or fastener 90, is then again tightened to clamp the work surface 12 and the accessory, or its mounting portion 123, between the cap member 92 and the support platform 38. In this way, an accessory can be easily attached to the table without the need for complicated mechanisms and fasteners. Moreover, the accessory is directly attached to the support structure, so as to provide a more robust support therefore. Once the accessory is attached to one or more support platforms 38, 52, the glide 68 attached to the foot or feet 32, 34 therebeneath can be rotated to lower the work surface 12 as needed, since it has now been raised a slight amount due to the additional thickness of the mounting plate 123.

Other accessories include a mounting member 128, shown in FIGS. 2–4, 11 and 12, preferably formed as a hook member from a tube, which has an L-shaped configuration with a horizontal leg 131 and a vertical leg 130. The mounting member 128 is attached to a mounting plate 123 having a slot 124 and an opening 125. The upstanding leg portion 130 is preferably spaced from the edge 14, 16, 18 of the work surface such that various items, for example personal articles such as a hat or coat, can be engaged thereon. The legs 130, 131 are preferably formed from a tube, or solid wire. The mounting member plate can be inserted between the support platform 138 and the bottom surface of the work surface, or between the top surface thereof and the cap member. Alternatively, the plate member 123 can be simply mounted to a top or bottom surface of the work surface with adhesive, mechanical fasteners and the like, or some combination thereof.

Figure 11:
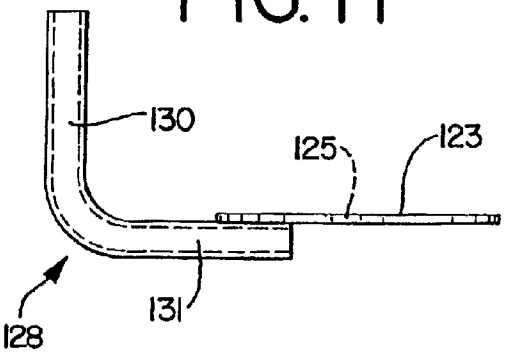
FIG. 11 is a side view of a mounting member.
Figure 12:
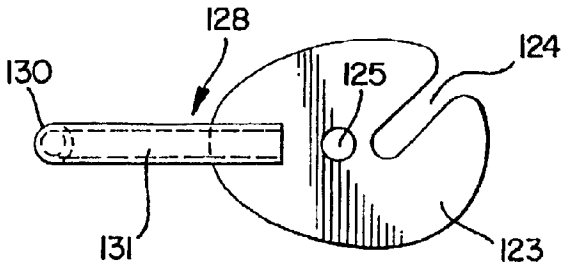
FIG. 12 is a top view of the mounting member.
Figure 15:
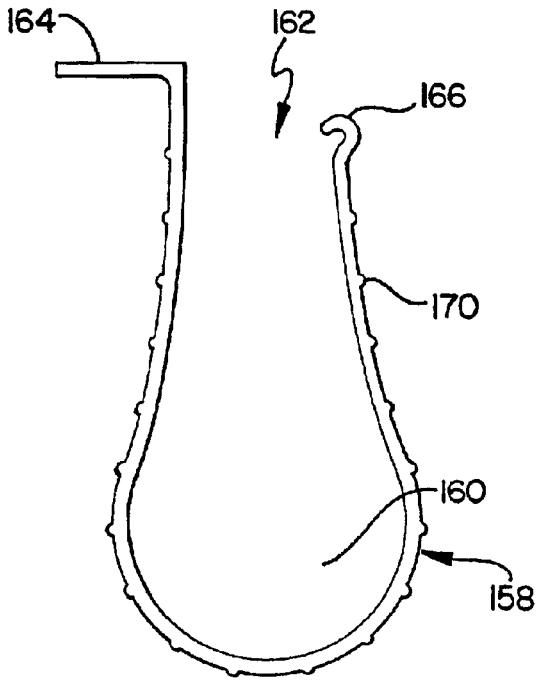
FIG. 15 is an end view of a cable trough.
Figure 16:
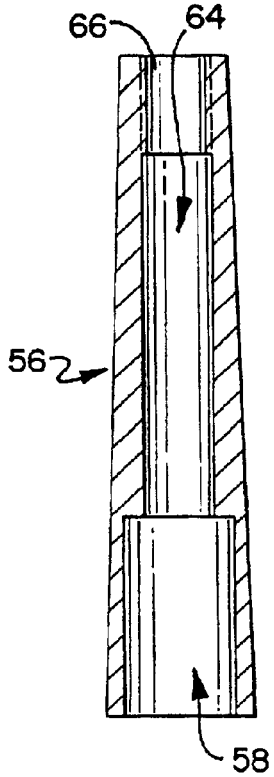
FIG. 16 is a cross-sectional view of a stem.
Figure 27:
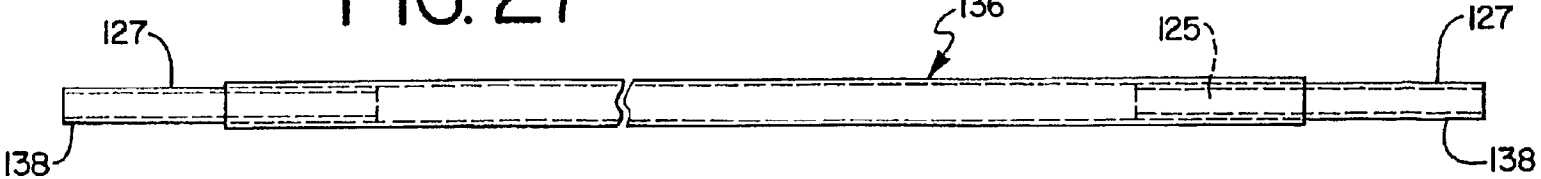
FIG. 27 is a side view of a pole.

Referring to FIGS. 1, 10A, 10B, 13 and 27, yet another accessory is formed as a screen 134. The screen 134 preferably includes a flexible pole 136, which is curved and extends out of a plane defined by the work surface 12. The pole is preferably made of fiberglass. As best shown in FIG. 27, the pole 136 includes an elongated tube 125 and a tubular insert 127, which is received in each end of the tube 125. Opposite ends 138 of the pole 136 are disposed in or connected to the mounting member 128. Preferably, the ends 138 of the pole inserts 127 are inserted into the hollow tube of the mounting member, which forms the upstanding leg 130. Preferably, the outer diameter of the tube 125 is substantially the same as the outer diameter of leg 130, so as to provide a continuous appearance as the insert 127 connects the tubes. The mounting plate 123 is preferably mounted between one of the support platform or the cap member and the work surface, as set forth above. Preferably, as shown in FIG. 11, the mounting plate 123 is disposed on one of the support platforms 38 positioned adjacent the front edge 14 of the table 10. The opposite end of the pole is preferably mounted to a mounting member 128 attached beneath the work surface at an approximate mid portion of the rear edge thereof.

The screen 134 preferably includes a sheet material web 140 made of a bi-directional stretchable material, such as a woven or knitted fabric preferably made of 85% nylon and 15% lycra. It should be understood that the bi-directional material can be stretched in any number of directions, e.g., diagonally and is not limited to stretching in only two directions. In this way, the sheet material web 140 can be cut from a simple two-dimensional pattern, as shown in FIG. 8A and 8B, and thereafter attached to the pole 136, wherein it can be stretched to assume various three-dimensional (3-D) configurations. In a preferred embodiment, shown for example in FIG. 1, one end 138 of the pole 136 is connected to the work surface, or table, along a side edge or comer thereof, while the opposite end of the pole is connected to the work surface or table, along a rear edge thereof. Of course, it should be understood, that the ends of the pole could be secured along opposite sides of the table, along the front and back edges of the table, or along the same edge thereof. Likewise, the screen could be mounted or secured to a table having a non-rectangular work surface, such as a circular, oval or elliptical work surface, wherein opposite ends of the pole are merely spaced apart along the edge of the work surface.

Figure 13:
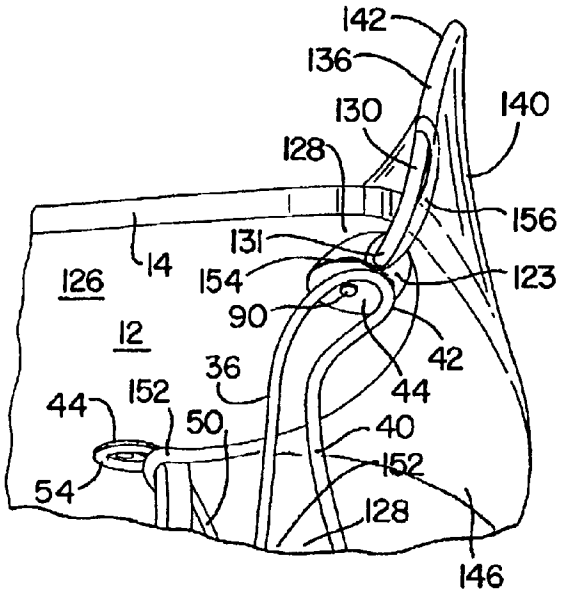
FIG. 13 is a partial bottom perspective view showing the attachment of the screen to the table.

In a preferred embodiment, as best shown in FIGS. 1, 10 and 13, the sheet material web 140 has a first edge portion 142, preferably formed as a loop 144, connected to the pole 136, preferably by inserting the pole 136 through the loop 144. The first edge 142 is preferably curved. The sheet material web 140 further includes a second edge portion 146, otherwise referred to as a free edge. The free edge 146 of the sheet material web is disposed beneath the work surface 12 such that the sheet material web engages one or more edges 14, 16, 18 of the work surface 12. The free edge preferably comprised a middle edge 148, having a curved portion, and two side edges 150. A pair of ties 152, which are preferably elastic straps, extend from the free edge, preferably at a junction between the side and middle edges. A pair of loops 154 or alternatively a pair of secondary ties, extend from the edge 150 adjacent a curved junction 156 formed between the first and second edges 142, 146. The ties 152 or straps are preferably pulled so as to stretch the sheet material web tight between the edges 16, 18 of the work surface and the pole 136. In one embodiment, the ties 152 are secured to the support structure, and in particular the support platform 52 or other mounting points, beneath the work surface 12 so as to stretch the sheet material web between the edges 16, 18 of the work surface and the pole 136. The ties 152 preferably terminate in loops 155 which can be connected and engaged by a hook, e.g., an S-shaped hook. In such an embodiment the ties are stretched to pull the sheet material web tight. The loops 154 can further be secured to or threaded over the mounting member 128 so as to help stretch the sheet material web 140 and maintain a smooth contour thereof.

Due to the curved nature and orientation of the pole, and the non-linear contour of the side and rear edges 16, 18 of the work surface 12, the sheet material web 140 assumes a non-planar, or 3-D contour. In a preferred embodiment, wherein the sheet material web 140 is stretched over a portion of a side and rear edge 18, 16 of the work surface, the sheet material web 140 assumes a unique half-dome shape having a convex outer surface. The screen is an ideal accessory for providing privacy from the back and side of the table, as well as from overhead, for example when shading from an overhead light is desired. In addition, the screen 134 is relatively light weight and easy to install in a variety of different positions.

Referring to FIGS. 1–4 and 15, a utility raceway 158, or trough, is shown as being attached to the work surface along the rear edge thereof. The raceway is preferably made of a flexible PVC material, which is preferably extruded. The raceway 158 has a generally U-shaped trough, with a bottom cavity 160 preferably having a greater diameter or width than the width of the mouth 162 of the trough. A horizontally extending mounting flange 164 extends outwardly from end of the trough, and is secured to the bottom 126 of the work surface with a plurality of fasteners. The opposite end of the trough terminates in a bead 166, which is spaced from and hangs loose adjacent the rear edge of the table. The outer surface 168 of the trough includes a plurality of longitudinally extending rib portions 170, which provide additional strength and rigidity to the raceway. In operation, various utilities, including phone lines, electrical cords, computer wires and the like, can be run over the rear edge 16 of the work surface 12 and be disposed in the raceway 158 for storage and the like. Alternatively, various items such as excess cords, lines, or even papers and documents, can be stored in the raceway. As shown in FIG. 1, various openings 171 can be formed in the bottom of the trough to allow passage of the utilities to outlets and the like on the floor positioned beneath the table.

Figure 14:
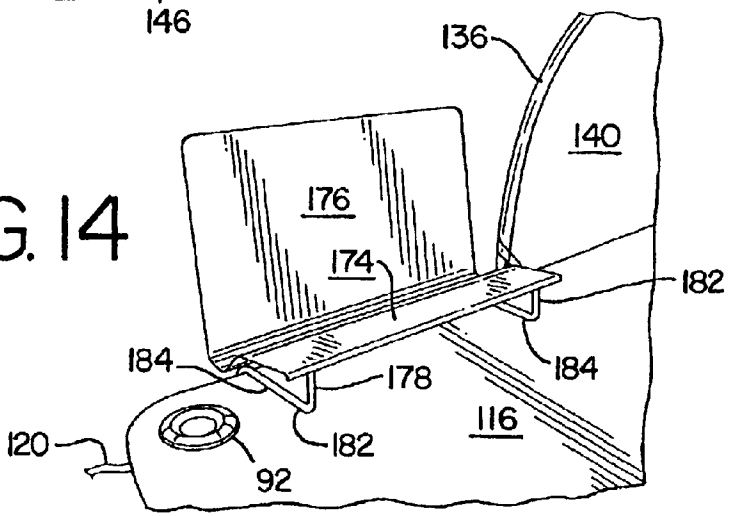
FIG. 14 is a perspective view of a support accessory.

Referring to FIGS. 1 and 14, a support accessory 172 is shown as comprising a base wall 174 and an upwardly extending back wall 176. A stand 178 is connected to the support accessory, and preferably includes a pair of legs 180 that are supported on top of the uppermost work surface 116. A pair of support feet 182 extend downwardly from a front portion of the base wall and form a pair of rails 184, which extend rearwardly beneath the support accessory and engage the work surface 116. The support feet 182 further include a pair of supports that extend beneath the worksurface. Various documents and other articles can be supported on the support accessory, and in particular are rested on the base wall 174 and leaned against the back wall 176.

Figure 19:
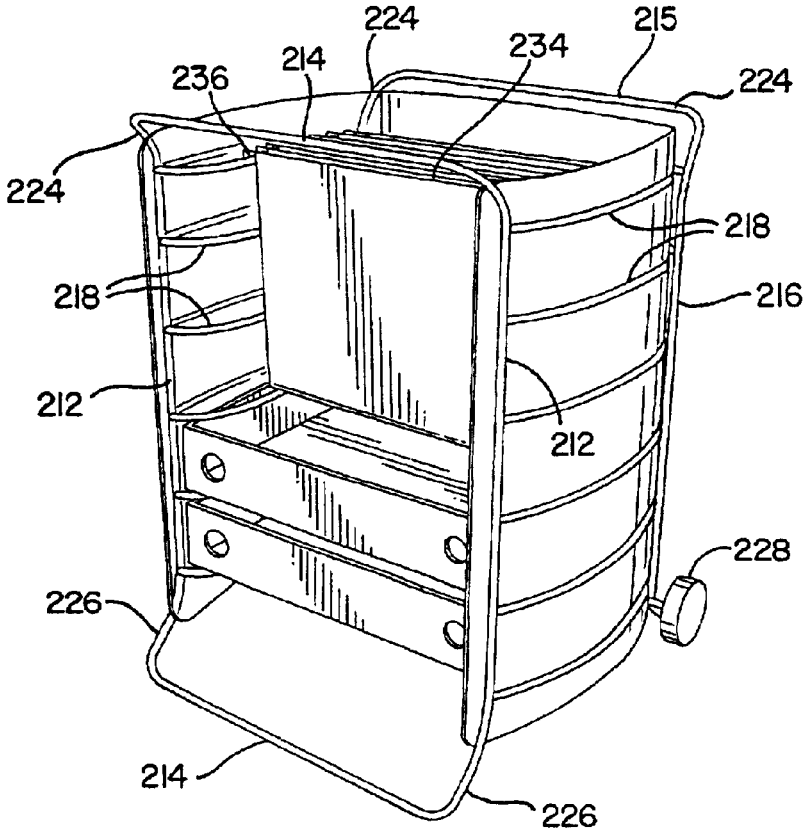
FIG. 19 is a perspective view of a storage device.
Figure 20:
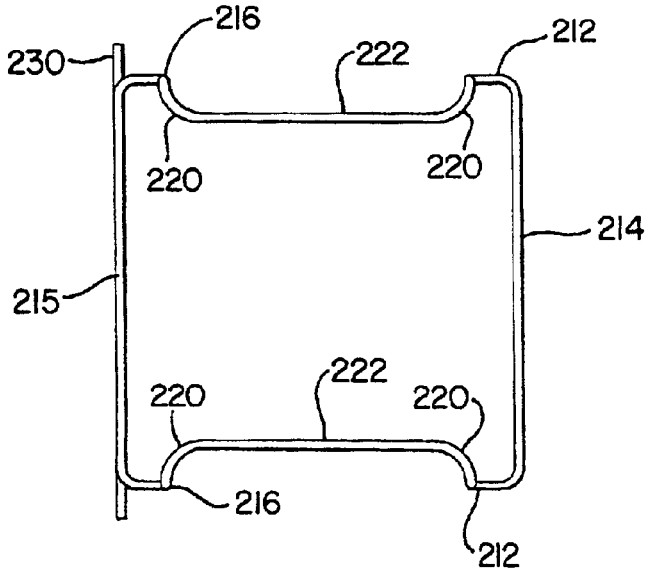
FIG. 20 is a top view of the storage device frame.
Figure 21:
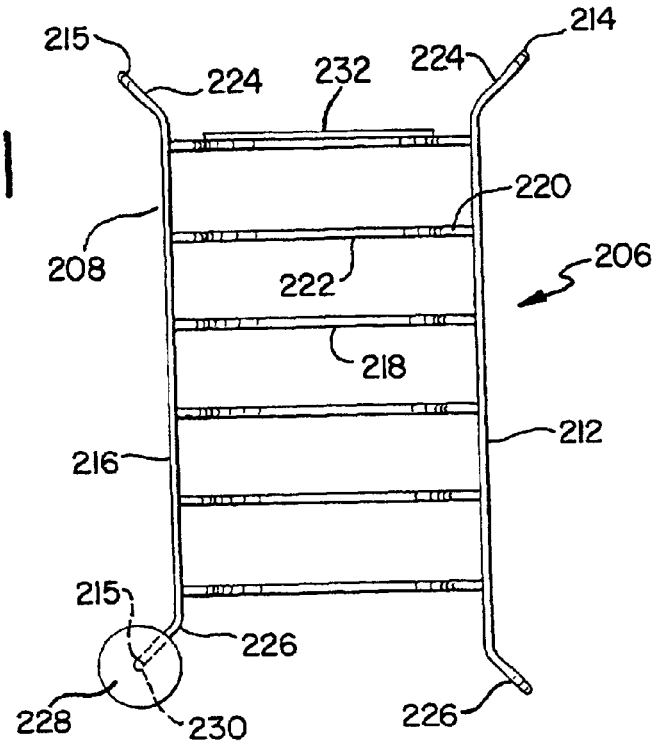
FIG. 21 is a side view of the storage device frame.
Figure 22:
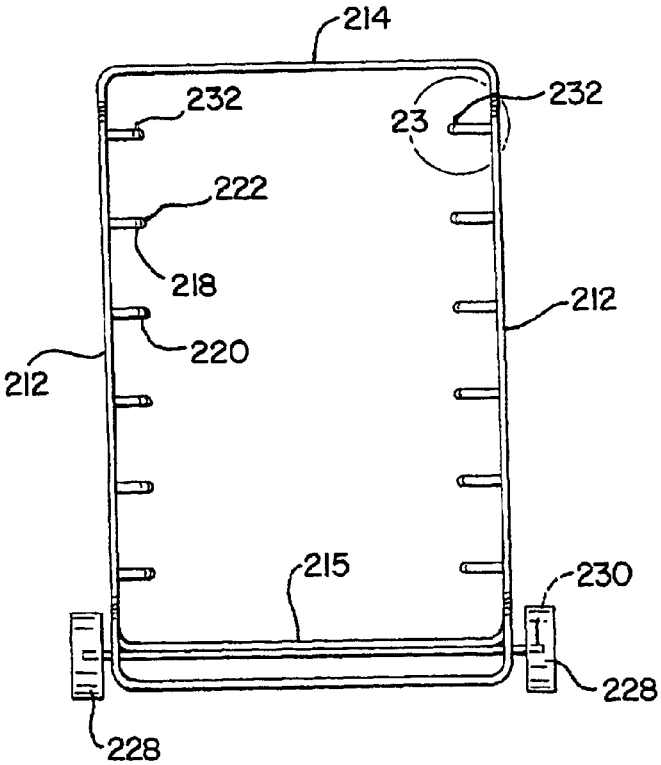
FIG. 22 is a front view of the storage device frame.
Figure 23:
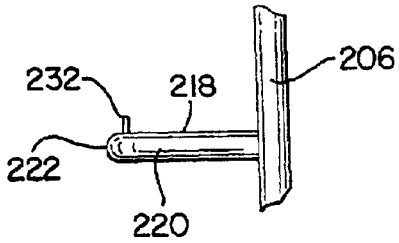
FIG. 23 is an enlarged front view of a side frame member with a file rail attached thereto.

Referring to FIGS. 1 and 19–25, a storage device 200 is shown as including a frame 202 and a sheet material web 204. The frame 202 includes a front and back frame member 206, 208, which are preferably formed from a wire and preferably have a generally rectangular shape, with a pair of vertical members 212, 216 and a pair of horizontal members 214, 215 joined thereto. The vertical members 212 on the front frame member 206 are preferably longer than the vertical members 216 on the back frame member 208. The frame further includes a plurality of vertically spaced side frame members 218, also preferably made of wire, that extend between and connect the front and back frame members 206, 208, and in particular the vertical members 212, 216 thereof. The side frame members 218 preferably include curved end portions 220, and a linear middle portion 222 which extends inwardly from the side of the storage unit. Referring to FIGS. 22 and 23, a rail 232 can be attached to one or more of the side frames 218, and preferably the uppermost side frames. The rails 232 on opposite side frames are spaced to support letter or legal sized, file holders 234, which have hook members 236 that are slidably supported on the rails 232. The rails 232 are preferably welded to the side frames 218. As shown in FIGS. 19, 20 and 22, the frame is generally open to the front, rear, bottom and top. The frame is further open along the sides thereof between the plurality of side frame members 218, as shown in FIG. 21.

The vertical members of the front and rear frame members each include an upper and lower portion 224, 226 that are angled slightly forward and rearward respectively. The upper horizontal frame member 214 of the front frame member 206 forms a convenient handle for the storage unit that can be grasped by the user to lift the lower member 214 off of the floor. The lower horizontal frame members 214, 215 on each of the front and rear frames 206, 208 provide a pair of support feet for the storage device. In a preferred embodiment, a pair of wheels 228 are secured to an axle 230, which is attached preferably to the rear frame 208 on the lower frame member 215 thereof. A pad can be disposed around the lower horizontal frame member 214 of the front frame 206 so as to cushion the frame and so as to prevent damage to the floor or other support surface. In use, the user can grasp the upper horizontal frame member 214 of the front frame member 206 as a handle and wheel the storage device from one location to another.

Figure 24:
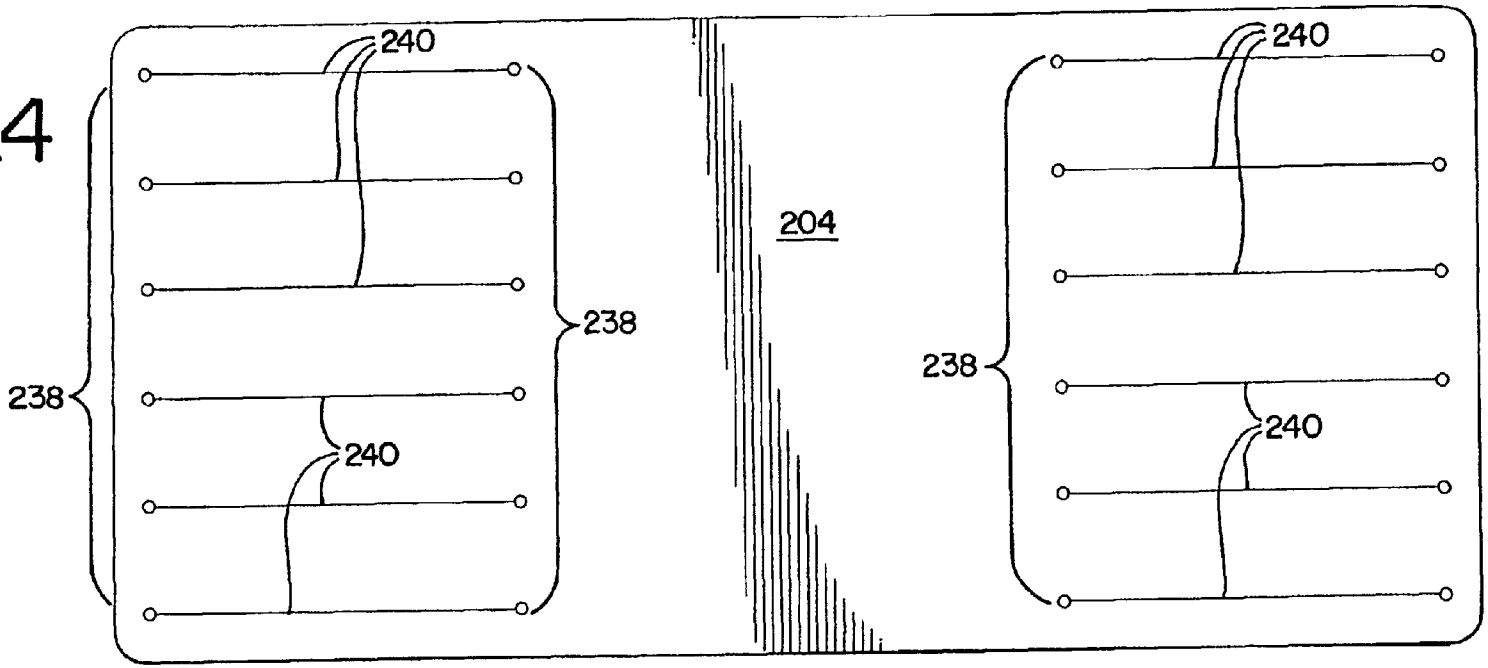
FIG. 24 is a view of a flat pattern layout of the storage device sheet material web.

The sheet material web 204, best shown in FIGS. 19 and 24, is preferably made of a flexible material, such as a woven fabric. In a preferred embodiment, the sheet material web is made of a flexible, semi-resilient plastic or a thermoplastic sheet, and is preferably made of PETG. The sheet material web can be made transparent, opaque or solid. In one embodiment, the sheet material web is wrapped around four surfaces of the frame, and preferably, the top, bottom and opposite sides thereof.

In an alternative embodiment, best shown in FIG. 19, the sheet material web is wrapped around three surfaces defined by the frame, including the rear and opposite sides of the frame. In this embodiment, the top, bottom and front of the storage device 200 remain generally open. As shown in FIG. 24, the sheet material web 204 includes four columns of a plurality of vertically spaced openings 238. Two pairs of columns are each spaced a distance approximate the distance between the front and back frame members 212, 216. The openings 238 in each column are vertically spaced so as to be aligned with the side frame members 218. A plurality of slits 240 are made in the web 204 and connect the horizontally displaced openings in each pair of columns. The sheet material web preferably is disposed inside the frame on the side frame members 218 by piercing the web 204 at the slits 240 with the side frame members 218. After the web 204 as passed over the side frame members, and in particular portions 222, at the slits 240, the slits 240 close and the side frame members, and in particular the curved portions thereof, extend through the openings 238 formed in the web. By way of the piercing of the sheet material web by the side frame members, the sheet material web is secured to the frame. The outer surface of the edges 241 of the web rest or abut against the inner surface of the vertical front frame members 212.

Figure 25:
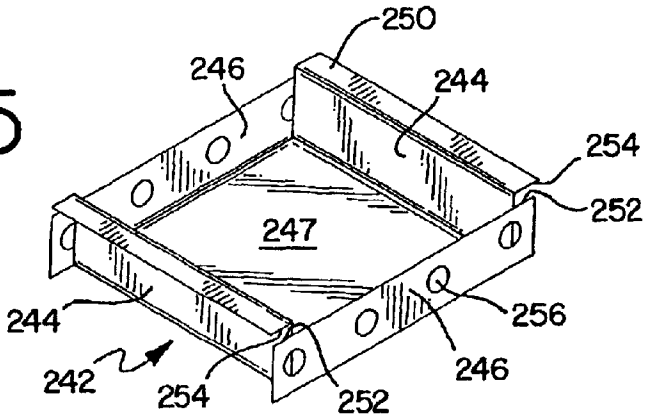
FIG. 25 is a perspective view of a storage tray.

As best shown in FIGS. 19 and 25 the storage device 200 further includes a tray 242 having side walls 244, a bottom 247 and a front and back wall 246. The front and back wall preferably include a plurality of openings 256 formed therein. The side walls include an outwardly extending flange 250 that engages and slides on opposite side frame members 218. The top edge of the end of the front and back walls 246 and the flange 250 form an opening through which the side frame member 218 is received.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A table comprising:

a support structure comprising a first wire support and a second wire support, each of said first and second wire supports comprising opposite ends joined to define a first and second foot and wherein a portion of said first and second wire supports form a first and second support platform respectively, wherein said first wire support comprises a first segment extending upwardly from said first foot to said first support platform and a second segment extending from said first support platform to said second foot, and wherein said second wire support comprises a first segment extending upwardly from said second foot to said second support platform and a second segment extending from said second support platform to said first foot;

a third wire support comprising opposite ends joined to said first and second feet, wherein a portion of said third wire support forms a third support platform, said third wire support comprising a first segment extending from said first foot to said third support platform and a second segment extending from said second foot to said third support platform; and a work surface supported on said first, second and third support platforms.

2. The table of claim 1 wherein said first support platform comprises a plate member attached to said first wire support.

3. The table of claim 1 wherein said opposite ends of said first and second wires are welded to form said first and second feet.

4. The table of claim 1 wherein said first and second wire members are each made of a single piece of wire.

5. The table of claim 1 further comprising a first collar attached to said first and second wire supports, and a second collar attached to said third wire support, and a fastener connecting said first and second collars.

6. The table of claim 1 further comprising a first and second cap member disposed on an upper surface of said work surface, wherein said first cap member is connected to said first support platform and wherein said second cap member is connected to said second support platform such that said work surface is clamped between said first and second cap members and said first and second support platforms respectively.

7. The table of claim 6 wherein at least a portion of said cap member is raised above said upper surface of said work surface, wherein said work surface comprises a first work surface, and further comprising a second work surface having a pair of openings shaped to receive said raised portion of said cap member, wherein said second work surface is disposed on said first work surface and is indexed on said first and second cap members.

8. The table of claim 1 further comprising an accessory having a mounting portion disposed between at least one of said first and second support platforms and said work surface.

9. The table of claim 8 wherein said accessory comprises a rail.

10. The table of claim 8 wherein said accessory comprises a screen.

11. The table of claim 10 wherein said screen comprises a curved pole extending out of a plane defined by said work surface from a side of said work surface to a rear of said worksurface.

12. The table of claim 11 wherein said screen is made of a bi-directional stretchable material.

13. The table of claim 1 further comprising a glide connected to each of said first and second feet.

14. The table of claim 13 further comprising a collar disposed over each of said first and second feet, wherein said glides are connected to said collars.

* * * * *